US012227714B2

(12) United States Patent
Thiebaut et al.

(10) Patent No.: US 12,227,714 B2
(45) **Date of Patent: *Feb. 18, 2025**

(54) LUBRICATING COMPOSITION FOR GEAR

(71) Applicant: TotalEnergies OneTech, Courbevoie (FR)

(72) Inventors: Benoit Thiebaut, Lyons (FR); Stéphane Gavand, Dardilly (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/784,760

(22) PCT Filed: Dec. 17, 2020

(86) PCT No.: PCT/EP2020/086668

§ 371 (c)(1),
(2) Date: Jun. 13, 2022

(87) PCT Pub. No.: WO2021/122913

PCT Pub. Date: Jun. 24, 2021

(65) Prior Publication Data

US 2023/0008086 A1 Jan. 12, 2023

(30) Foreign Application Priority Data

Dec. 20, 2019 (EP) ..... 19306726

(51) Int. Cl.

| | |
|---|---|
| ***C10M 125/22*** | (2006.01) |
| ***C10M 169/04*** | (2006.01) |
| *C10N 10/12* | (2006.01) |
| *C10N 20/00* | (2006.01) |
| *C10N 20/06* | (2006.01) |
| *C10N 30/02* | (2006.01) |
| *C10N 30/04* | (2006.01) |
| *C10N 40/04* | (2006.01) |
| *C10N 60/00* | (2006.01) |
| *C10N 70/00* | (2006.01) |

(52) U.S. Cl.

CPC ..... *C10M 125/22* (2013.01); *C10M 169/04* (2013.01); *C10M 2201/066* (2013.01); *C10N 2010/12* (2013.01); *C10N 2020/06* (2013.01); *C10N 2020/061* (2020.05); *C10N 2030/02* (2013.01); *C10N 2030/04* (2013.01); *C10N 2040/04* (2013.01); *C10N 2060/01* (2020.05); *C10N 2070/00* (2013.01)

(58) Field of Classification Search

CPC ..... C10M 125/22; C10M 169/04; C10M 2201/066; C10N 2010/12; C10N 2020/06; C10N 2020/061; C10N 2030/02; C10N 2030/04; C10N 2040/04; C10N 2060/01; C10N 2070/00

See application file for complete search history.

(56) References Cited

U.S. PATENT DOCUMENTS

| | | | | |
|---|---|---|---|---|
| 4,075,111 | A * | 2/1978 | Bilow | C10M 111/04 508/108 |
| 8,486,870 | B1 * | 7/2013 | Malshe | C10M 171/00 508/108 |
| 8,492,319 | B2 * | 7/2013 | Malshe | C10M 171/06 508/172 |
| 2005/0065044 | A1 * | 3/2005 | Migdal | C10M 171/06 508/363 |
| 2014/0235513 | A1 * | 8/2014 | Kverel | C25D 15/00 508/108 |
| 2017/0226442 | A1 * | 8/2017 | Sanson | C10M 107/34 |
| 2018/0223213 | A1 * | 8/2018 | García Alonso | C08K 9/08 |
| 2018/0291305 | A1 * | 10/2018 | Kumar Tompala | C10M 101/02 |

FOREIGN PATENT DOCUMENTS

WO 2016/156543 A1 10/2016

OTHER PUBLICATIONS

International Search Report issued in PCT/EP2020/086668 dated Feb. 25, 2021.

Extended European Search Report issued in EP 19 30 6726 dated Jun. 12, 2020.

* cited by examiner

*Primary Examiner* — Ellen M McAvoy

(74) *Attorney, Agent, or Firm* — TROUTMAN PEPPER LOCKE LLP

(57) ABSTRACT

The present invention relates to the use of a lubricating composition for lubricating gear, wherein the lubricating composition comprises:

at least a base oil; and at least a Molybdenum or Tungsten chalcogenide nanoobject having an object size ranging from 0.1 to 500 nm and from 1 to 99% by weight of molecules of formula (I) with respect to the total weight of the nanoobject

A-X-B (I).

12 Claims, No Drawings

LUBRICATING COMPOSITION FOR GEAR

CROSS REFERENCE TO RELATED APPLICATIONS

The present application is a U.S. National Phase Application under 35 U.S.C. § 371 of International Patent Application No. PCT/EP2020/086668 filed Dec. 17, 2020, which claims priority of European Patent Application No. 19306726.1 filed Dec. 20, 2019. The entire contents of which are hereby incorporated by reference.

FIELD OF THE INVENTION

The present invention concerns lubricating composition for gears (such as transmission, gearbox, reducer, etc.) and more specifically lubricating composition providing scaling resistant properties and enabling an increase of the yield of the gear.

BACKGROUND

Lubricant compositions for transmissions (for example gearboxes or differential housings) or for gearing, in particular for industrial gearing, must satisfy many requirements, in particular related to driving comfort (smooth gear shift, quiet running, trouble-free operation, high reliability), to the service life of the assembly (reduction of wear during cold gear shift, no deposits and high thermal stability, safety of lubrication at high temperatures, stable viscosity condition and absence of shear loss, long service life) as well as to consideration of environmental aspects (lower fuel consumption, reduced lubricant consumption, low noise, easy drainage). These comprise, in particular, requirements for lubricant compositions for manual gearboxes and axle gearing. Concerning the requirements imposed on the automatic gearbox oils (ATF), they are very specific and relate in particular to high constancy of the coefficient of friction during all its life for an optimal gearshift, excellent aging stability for long drainage intervals, good viscosity-temperature performance to ensure perfect operation with a hot engine as well as a cold engine, and sufficient sealing compatibility with the various elastomers used in the transmission seals so that they do not swell, do not shrink, and do not become fragile. Moreover, in the automotive field, the search for the reduction of CO2 emissions requires the development of products that reduce friction in gearboxes and differential housings. This reduction of friction in gearboxes and in differential housings must be achieved under different operating conditions. This reduction of friction must cover the internal friction of the lubricant but also the friction of the elements constituting the gearboxes or differential housings, in particular the metal elements.

The improvement of yield of gears leads to a reduction of viscosity of the lubricating composition. Hard lubricating regimen increases and usual tribochemistry tribofilms become inoperative and problems of durability appear.

Oils of high viscosity for energy efficiency and specific formulations against pitting have been developed. However, the resulting tribofilms and performance are limited.

There is thus a need to provide new lubricating composition for gears.

SUMMARY

An object of the present invention is to provide a new lubricating composition for gears.

Another object of the invention is to provide such lubricating composition providing scaling resistant properties.

Another object of the invention is to provide such lubricating composition enabling an increase of the yield of the gear.

Other objects of the invention will appear by reading the following description of the invention.

The present invention thus provides the use of a lubricating composition for lubricating gear, wherein the lubricating composition comprises:

At least a base oil; and

At least a Molybdenum or Tungsten chalcogenide nanoobject having an object size ranging from 0.1 to 500 nm and from 1 to 99% by weight of molecules of formula (I) with respect to the total weight of the nanoobject

A-X-B (I)

wherein A is OH or SH;

X is a biradical selected from the group consisting of (C1-C20)alkyl; (C1-C20)alkyl substituted with one or more radicals independently selected from the group consisting of: (C1-C5)alkyl, —OH, halogen, phenyl, phenyl substituted with one or more (C1-C4)alkyl radicals, phenyl substituted with one or more halogen radicals, benzyl, benzyl substituted with one of more (C1-C4)alkyl radicals, benzyl substituted with one or more halogen radicals, —C(=O)$R^3$, —C(=O)$R^7$, —OC(=O)(O)$R^3$, —C(=O)($O^-$), —C(=O)(O)$R^3$, —O$R^3$, —CH(O$R^3$)(O$R^4$), —C(O$R^3$)(O$R^4$)$R^5$, —C(O$R^3$)(O$R^4$)(O$R^5$), —C(O$R^3$)(O$R^4$)(O$R^5$)(O$R^6$), —N$R^1R^2$, —$N^+R^1R^2R^3$, —C(=N$R^1$)$R^2$, —C(=O)(N$R^1R^2$), —N(C(=O)($R^1$))(C(=O)($R^2$))($R^3$), —O(CN), —NC(=O), —$ONO_2$, —CN, —NC, —ON(=O), —$NO_2$, —NO, —$C_5H_4N$, —S$R^1$, —SS$R^1$, —S(=O)$R^1$, —S(=O)(=O)($R^1$), —S(=O)(OH), —S(=O)(=O)(OH), —SCN, —NCS, —C(=S)($R^1$), —P$R^1R^2$, —P(=O)$(OH)_2$, —OP(=O)$(OH)_2$, —OP(=O)(O$R^1$)(O$R^2$), —B(OH), —B(O$R^1$)(O$R^2$) and —B(O$R^1$)($R^2$); a 2 to 20-member heteroalkyl; a 2 to 20-member heteroalkyl substituted with one or more radicals independently selected from the group consisting of: —OH, halogen, phenyl, phenyl substituted with one or more (C1-C4)alkyls, phenyl substituted with one or more halogen radicals, benzyl, benzyl substituted with one or more (C1-C4)alkyls, benzyl substituted with one or more halogen radicals, —C(=O)$R^3$, —C(=O)($R^7$), —OC(=O)(O)$R^3$, —C(=O)($O^-$), —C(=O)(O)$R^3$, —O$R^3$, —CH(O$R^3$)(O$R^4$), —C(O$R^3$)(O$R^4$)($R^5$), —C(O$R^3$)(O$R^4$)(O$R^5$), —C(O$R^3$)(O$R^4$)(O$R^5$)(O$R^6$), —N$R^1R^2$, —$N^+R^1R^2R^3$, —C(=N$R^1$)($R^2$), —C(=O)(N$R^1R^2$), —N(C(=O)($R^1$))(C(=O)($R^2$))($R^3$), —O(CN), —NC(O), —$ONO_2$, —CN, —NC, —ON(=O), —$NO_2$, —NO, —$C_5H_4N$, —S$R^1$, —SS$R^1$, —S(=O)($R^1$), —S(=O)(=O)($R^1$), —S(=O)(OH), —S(=O)(=O)(OH), —SCN, —NCS, —C(=S)($R^1$), —P$R^1R^2$, —P(=O)$(OH)_2$, —OP(=O)$(OH)_2$, —OP(=O)(O$R^1$)(O$R^2$), —B(OH), —B(O$R^1$)(O$R^2$) and —B(O$R^1$)($R^2$); and a homopolymer or copolymer comprising a polymeric chain selected from the group consisting of: alkyd resin, epoxy resin, phenolic resin, polyvinyl halides, polyacetal, polyacrylics, polyalkylenes, polyalkenylenes, polyalkynylenes, polyamic acids, polyamides, polyamines, polyanhydrides, polyarylenealkylenes, polyarylenes, polyazomethines, polybenzimidazoles, polybenzothiazoles, polybenzyls, polycarbodiimides, polycarbonates, polycarbones, polycarboranes, polycarbosilanes, polycyanurates, polydienes, polyester-polyurethanes, polyesters, polyetheretherketones, polyether-polyurethanes, polyethers, polyhydrazides, polyimidazoles, polyimides, polyisocyanurates, polyketones, polyolefines, polyoxyalkylenes, polyoxyphenylenes, polyphenyls, polyphosphazenes, polypyrroles, polypyrrones, polyquinolines, polyquinoxalines, polysilanes, polysilazanes, polysiloxanes, polysilsesquioxanes, polysulfides, polysulfonamides, polysulfones, polythiazoles, polythiomethylenes, polythiophenylenes, polyureas, polyurethanes, polyvinyl acetals, polyvinyl butyrals, polyvinyl formals, polyvinyl alkanoates, vinyl polymers, and natural polymers;

B is a radical selected from the group consisting of: H, —OH, —$NH_2$, (C1-C4)alkyl, halogen, phenyl substituted with one or more halogen radicals, benzyl substituted with one or more halogen radicals, —C(═O)$R^3$, —C(═O)$R^7$, —OC(═O)(O)$R^3$, —C(═O)($O^-$), —C(═O)(O)$R^3$, —$OR^3$, —CH($OR^3$)($OR^4$), —C($OR^3$)($OR^4$)($R^5$), —C($OR^3$)($OR^4$)($OR^5$), —C($OR^3$)($OR^4$)($OR^5$)($OR^6$), —$NR^1R^2$, —$N^+R^1R^2R^3$, —C(═$NR^1$)($R^2$), —C(═O)($NR^1R^2$), —N(C(═O)($R^1$))(C(═O)($R^2$))($R^3$), —O(CN), —NC(═O), —$ONO_2$, —CN, —NC, —ON(═O), —$NO_2$, —NO, —$C_5H_4N$, —$SR^1$, —$SSR^1$, —S(═O)($R^1$), —S(═O)(═O)($R^1$), —S(═O)(OH), —S(═O)(═O)(OH), —SCN, —NCS, —C(═S)($R^1$), —$PR^1R^2$, —P(═O)$(OH)_2$, —OP(═O)$(OH)_2$, —OP(═O)($OR^1$)($OR^2$), —B(OH), —B($OR^1$)($OR^2$) and —B($OR^1$)($R^2$);

provided that:

when B is H or (C1-C4)alkyl, then X is a 2 to 20-member heteroalkyl; a 2 to 20-member heteroalkyl substituted with one or more radicals, as defined above, or a homopolymer or copolymer, as defined above; and B is H or (C1-C4)alkyl when X is a homopolymer, copolymer, a 2 to 20-member heteroalkyl or a 2 to 20-member heteroalkyl substituted as defined above; and when B is —$NH_2$, then X is a biradical selected from the group consisting of (C1-C20)alkyl; (C1-C20) alkyl substituted with one or more radicals independently selected from the group consisting of: (C1-C5) alkyl, —OH, halogen, phenyl, phenyl substituted with one or more (C1-C4)alkyl radicals, phenyl substituted with one or more halogen radicals, benzyl, benzyl substituted with one of more (C1-C4)alkyl radicals, benzyl substituted with one or more halogen radicals, —C(═O)$^{R3}$, —C(═O)$R^7$, —OC(═O)($OR^3$), —C(═O)($O^-$), —C(═O)(O)$R^3$, —$OR^3$, —CH($OR^3$)($OR^4$), —C($OR^3$)($OR^4$)$R^5$, —C($OR^3$)($OR^4$)($OR^5$), —C($OR^3$)($OR^4$)($OR^5$)($OR^6$), —$NR^1R^2$, —$N^+R^1R^2R^3$, —C(═$NR^1$)$R^2$, —C(═O)($NR^1R^2$), —N(C(═O)($R^1$))(C(═O)($R^2$))($R^3$), —O(CN), —NC(═O), —$ONO_2$, —CN, —NC, —ON(═O), —$NO_2$, —NO, —$C_5H_4N$, —$SR^1$, —$SSR^1$, —S(═O)R, —S(═O)(═O)($R^1$), —S(═O)(OH), —S(═O)(═O)(OH), —SCN, —NCS, —C(═S)($R^1$), —$PR^1R^2$, —P(═O)$(OH)_2$, —OP(═O)$(OH)_2$, —OP(═O)($OR^1$)($OR^2$), —B(OH), —B($OR^1$)($OR^2$) and —B($OR^1$)($R^2$); a 2 to 20-member heteroalkyl; a 2 to 20-member heteroalkyl substituted with one or more radicals independently selected from the group consisting of: —OH, halogen, phenyl, phenyl substituted with one or more (C1-C4)alkyls, phenyl substituted with one or more halogen radicals, benzyl, benzyl substituted with one or more (C1-C4)alkyl radicals, benzyl substituted with one or more halogen radicals, —C(═O)$R^3$, —C(═O)($R^7$), —OC(═O)(O)$R^3$, —C(═O)($O^-$), —C(═O)(O)$R^3$, —$OR^3$, —CH($OR^3$)($OR^4$), —C($OR^3$)($OR^4$)($R^5$), —C($OR^3$)($OR^4$)($OR^5$), —C($OR^3$)($OR^4$)($OR^5$)($OR^6$), —$NR^1R^2$, —$N^+R^1R^2R^3$, —C(═$NR^1$)($R^2$), —C(═O)($NR^1R^2$), —N(C(═O)($R^1$))(C(═O)($R^2$))($R^3$), —O(CN), —NC(O), —$ONO_2$, —CN, —NC, —ON(═O), —$NO_2$, —NO, —$C_5H_4N$, —$SR^1$, —$SSR^1$, —S(═O)($R^1$), —S(═O)(═O)($R^1$), —S(═O)(OH), —S(═O)(═O)(OH), —SCN, —NCS, —C(═S)($R^1$), —$PR^1R^2$, —P(═O)$(OH)_2$, —OP(═O)$(OH)_2$, —OP(═O)($OR^1$)($OR^2$), —B(OH), —B($OR^1$)($OR^2$) and —B($OR^1$)($R^2$);

$R^1$, $R^2$, $R^3$, $R^4$, $R^5$ and $R^6$ are radicals independently selected from the group consisting of H, (C1-C20) alkyl, (C6-C12)aryl(C1-C20)alkyl and (C6-C12)aryl;

$R^7$ is halogen;

2 to 20-member heteroalkyl represents a known non-polymeric C-heteroalkyl radical consisting of from 2 to 20 members where at least one of the members is O, S or NH, and the remaining members are selected from CH, C(═O) and $CH_2$; and (C6-C12)aryl represents a ring system from 5 to 12 carbon atoms, the system comprising from 1 to 2 rings, where each one of the rings forming the ring system: is saturated, partially unsaturated or aromatic; and is isolated, partially or totally fused.

Preferably, the compound of formula (I) functionalizing the chalcogenide nano-object if of polar nature, either by the specific polar nature of A and B radicals, or by the specific polar nature of X when it is a homopolymer or copolymer as defined above.

Preferably, in the present invention,

A is OH;

X is a biradical selected from the group consisting of (C1-C20)alkyl; (C1-C20)alkyl substituted with one or more radicals independently selected from the group consisting of: (C1-C5)alkyl, —OH, halogen, phenyl, phenyl substituted with one or more (C1-C4)alkyl radicals, phenyl substituted with one or more halogen radicals, benzyl, benzyl substituted with one of more (C1-C4)alkyl radicals, benzyl substituted with one or more halogen radicals, —C(═O)$R^3$, —C(═O)$R^7$, —OC(═O)(O)$R^3$, —C(═O)($O^-$), —C(═O)(O)$R^3$, —$OR^3$, —CH($OR^3$)($OR^4$), —C($OR^3$)($OR^4$)$R^5$, —C($OR^3$)($OR^4$)($OR^5$), —C($OR^3$)($OR^4$)($OR^5$)($OR^6$), —$NR^1R^2$, —$N^+R^1R^2R^3$, —C(═$NR^1$)$R^2$, —C(═O)($NR^1R^2$), —N(C(═O)($R^1$))(C(═O)($R^2$))($R^3$), —O(CN), —NC(═O), —$ONO_2$, —CN, —NC, —ON(═O), —$NO_2$, —NO, —$C_5H_4N$, —$SR^1$, —$SSR^1$, —S(═O)$R^1$, —S(═O)(═O)($R^1$), —S(═O)(OH), —S(═O)(═O)(OH), —SCN, —NCS, —C(═S)($R^1$), —$PR^1R^2$, —P(═O)$(OH)_2$, —OP(═O)$(OH)_2$, —OP(═O)($OR^1$)($OR^2$), —B(OH), —B($OR^1$)($OR^2$) and —B($OR^1$)($R^2$); a 2 to 20-member heteroalkyl; a 2 to 20-member heteroalkyl substituted with one or more radicals independently selected from the group consisting of: —OH, halogen, phenyl, phenyl substituted with one or more (C1-C4)alkyls, phenyl substituted with one or more halogen radicals, benzyl, benzyl substituted with one or more (C1-C4)alkyls, benzyl substituted with one or more halogen radicals, —C(═O)$R^3$, —C(═O)($R^7$), —OC(═O)(O)$R^3$, —C(═O)($O^-$), —C(═O)(O)$R^3$, —$OR^3$, —CH($OR^3$)($OR^4$), —C($OR^3$)($OR^4$) ($R^5$), —C($OR^3$)($OR^4$)($OR^5$), —C($OR^3$)($OR^4$)($OR^5$)($OR^6$), —$NR^1R^2$, —$N^+R^1R^2R^3$, —C(═$NR^1$)($R^2$), —C(═O)($NR^1R^2$), —N(C(═O)($R^1$))(C(═O)($R^2$))($R^3$), —O(CN), —NC(O), —$ONO_2$, —CN, —NC, —ON(═O), —$NO_2$, —NO, —$C_5H_4N$, —$SR^1$, —$SSR^1$, —S(=O)($R^1$), —S(=O)(=O)($R^1$), —S(=O)(OH), —S(=O)(=O)(OH), —SCN, —NCS, —C(=S)($R^1$), —$PR^1R^2$, —P(=O)$(OH)_2$, —OP(=O)$(OH)_2$, —OP(=O)($OR^1$)($OR^2$), —B(OH), —B($OR^1$)($OR^2$) and —B($OR^1$)($R^2$); and a homopolymer or copolymer comprising a polymeric chain selected from the group consisting of: alkyd resin, epoxy resin, phenolic resin, polyvinyl halides, polyacetal, polyacrylics, polyalkylenes, polyalkenylenes, polyalkynylenes, polyamic acids, polyamides, polyamines, polyanhydrides, polyarylenealkylenes, polyarylenes, polyazomethines, polybenzimidazoles, polybenzothiazoles, polybenzyls, polycarbodiimides, polycarbonates, polycarbones, polycarboranes, polycarbosilanes, polycyanurates, polydienes, polyester-polyurethanes, polyesters, polyetheretherketones, polyether-polyurethanes, polyethers, polyhydrazides, polyimidazoles, polyimides, polyisocyanurates, polyketones, polyolefines, polyoxyalkylenes, polyoxyphenylenes, polyphenyls, polyphosphazenes, polypyrroles, polypyrrones, polyquinolines, polyquinoxalines, polysilanes, polysilazanes, polysiloxanes, polysilsesquioxanes, polysulfides, polysulfonamides, polysulfones, polythiazoles, polythiomethylenes, polythiophenylenes, polyureas, polyurethanes, polyvinyl acetals, polyvinyl butyrals, polyvinyl formals, polyvinyl alkanoates, vinyl polymers, and natural polymers;

B is a radical selected from the group consisting of: H, —OH, halogen, phenyl substituted with one or more halogen radicals, benzyl substituted with one or more halogen radicals, —C(=O)$R^3$, —C(=O)$R^7$, —OC(=O)(O)$R^3$, —C(=O)(0-), —C(=O)(O)$R^3$, —$OR^3$, —CH($OR^3$)($OR^4$), —C($OR^3$)($OR^4$)($R^5$), —C($OR^3$)($OR^4$)($OR^5$), —C($OR^3$)($OR^4$)($OR^5$)($OR^6$), —$NR^1R^2$, —$N^+R^1R^2R^3$, —C(=$NR^1$)($R^2$), —C(=O)($NR^1R^2$), —N(C(=O)($R^1$))(C(=O)($R^2$))($R^3$), —O(CN), —NC(=O), —$ONO_2$, —CN, —NC, —ON(=O), —$NO_2$, —NO, —$C_5H_4N$, —$SR^1$, —$SSR^1$, —S(=O)($R^1$), —S(=O)(=O)($R^1$), —S(=O)(OH), —S(=O)(=O)(OH), —SCN, —NCS, —C(=S)($R^1$), —$PR^1R^2$, —P(=O)$(OH)_2$, —OP(=O)$(OH)_2$, —OP(=O)($OR^1$)($OR^2$), —B(OH), —B($OR^1$)($OR^2$) and —B($OR^1$)($R^2$).

The Molybdenum and Tungsten chalcogenide nano-object are as described in WO2016/156543. The process of preparation of such objects is also described in WO2016/156543. Document WO2016/156543 is hereby incorporated by reference.

In the present invention the term "nano-object" refers to a primary particle (non-agglomerated single particle) with one, two or three external dimensions in the nanoscale, as already recognized by International Organization for Standardization in the document with the reference number ISO/TS 27687:2008(E). Illustrative non-limitative examples of nano-objects are: nanoparticles, which are nanoobjects with all three external dimensions in the nanoscale (if the lengths of the longest to the shortest axes of the nanoobject differ significantly, typically by more than three times, the terms nanofiber or nanoplate are intended to be used instead of the term nanoparticle); nanosheets (or nanoplates or nanolayers), which are nanoobjects with one external dimension in the nanoscale and the two other external dimensions significantly larger, wherein the smallest external dimension is the thickness of the nanosheets, the two significantly larger dimensions are considered to differ from the nanoscale dimension by more than three times, and the larger external dimensions are not necessarily in the nanoscale; nanofibers, which are nanoobjects with two similar external dimensions in the nanoscale and the third dimension significantly larger, wherein the nanofibers can be flexible or rigid and the two similar external dimensions are considered to differ in size by less than three times and the significantly larger external dimension in considered to differ from the other two by more than three times, and the largest external dimension is not necessarily in the nanoscale; nanotubes, which are hollow nanofibers; nanorods, which are solid nanofibers; nanowires, which are electrically conducting or semi-conducting nanofibers; and quantum dots, which are crystalline nanoparticles exhibiting size-dependent properties due to quantum confinement effects on the electronic states.

The term "object size" when referred to the nanoobject of the invention refers to a characteristic physical dimension of the primary particle. For example, in the case of a spherical nanoobject, the "object size" corresponds to the diameter of the nanoobject. In the case of a rod-shaped nanoobject with a circular cross-section, as it is the case of a nanofiber (either as such or in the form of a nanowire or nanotube), the "object size" of the nanoobject corresponds to the diameter of the cross-section of the nanoobject. In the case of a box-shaped nanoobject, such as a nanosheet, nanocube, a nanobox, or a nanocage, the size of the nanoobject corresponds to the thickness. When referring to a set of nanoobjects being of a particular size, it is contemplated that the set of nanoobjects can have a distribution of sizes around the specified size.

The size of the nanoobjects of the invention can be determined using well-known techniques in the state of the art such as Transmission Electron Microscopy (TEM). Images were chosen to be as representative of bulk sample as possible. TEM observations were performed in a JEOL2010F operating with 200 KV accelerating voltage equipped with Energy Dispersive Spectroscopy (EDS). The measured dimension was chosen depending on the morphology of the nanoobject as described above.

In the present invention, the term "chalcogenide" means a chemical compound consisting of at least one chalcogen anion and at least one more electropositive element. In one embodiment, the chalcogenide is a sulfide, selenide or telluride.

In the present invention, the term "polymeric chain" means a molecule of high relative molecular mass, the structure of which essentially comprises the multiple repetitions of units derives, actually or conceptually, from molecules of low relative molecular mass.

In the present invention, the term "natural polymers" can be defined as naturally occurring polymers which are produced in living organism. The most important naturally occurring polymers are proteins, polysaccharides (e.g. cellulose, starch, and cotton), nucleic acids (e.g. DNA, RNA) and natural rubber.

According to the present invention, a ring system formed by "isolated" rings means that the ring system is formed by two rings and said rings are bound via a bond from the atom of one ring to the atom of the other ring. The term "isolated" also embraces the embodiment in which the ring system has only one ring. Illustrative non-limitative examples of known ring systems consisting of one ring are those derived from: cyclopropyl, cyclobutyl, cylopentyl, cyclohexyl, cycloheptyl, cyclopropenyl, cyclobutenyl, cyclopentenyl, phenyl, biphenyl and cycloheptenyl.

According to the present invention when the ring system has "totally fused" rings, it means that the ring system is formed by two rings in which two or more atoms are common to two adjoining rings. Illustrative non-limitative examples are 1,2,3,4-tetrahydronaphthyl, and 1-naphthyl, 2-naphthyl.

In the present invention, the term "(%) by weight" refers to the percentage of each ingredient of the nanoobject or composition in relation to the total weight. As it is explained in detail below, the % by weight of molecules of formula (I) in relation of the total weight of the nanoobject has been determined by Thermal Gravimetric Analysis (TGA).

Preferably, the metal chalcogenide is a Molybdenum chalcogenide of sulfide, selenide or telleride. More preferably, the metal chalcogenide is $MoS_2$.

DETAILED DESCRIPTION

In one embodiment, the nanoobject comprises from 15 to 99% by weight of molecules of formula (I) with respect to the total weight of the nanoobject. Preferably, the nanoobject comprises from 30 to 99% by weight of molecules of formula (I) with respect to the total weight of the nanoobject, preferably from 40 to 99%, more preferably from 40 to 95% by weight of molecules of formula (I) with respect to the total weight of the nanoobject.

In another embodiment, X is a homopolymer or copolymer comprising a polymeric chain selected from the group consisting of: alkyd resin, epoxy resin, phenolic resin, polyvinyl halides, polyacetal, polyacrylics, polyalkylenes, polyalkenylenes, polyalkynylenes, polyamides, polyamines, polyanhydrides, polycarbonates, polyester-polyurethanes, polyesters, polyetheretherketones, polyether-polyurethanes, polyethers, polyimidazoles, polyimides, polyisocyanurates, polyketones, polyolefines, polyoxyalkylenes, polyoxyphenylenes, polypyrroles, polysiloxanes, polysulfides, polysulfonamides, polysulfones, polythiazoles, polythiomethylenes, polythiophenylenes, polyureas, polyurethanes, polyvinyl acetals, polyvinyl butyrals, polyvinyl formals polyvinyl alkanoates, vinyl polymers, and natural polymers. Preferably, X is a homopolymer or copolymer comprising a polymeric chain selected from the group consisting of: epoxy resin, phenolic resin, polyvinyl halides, polyacetal, polyacrylics, polyamides, polyamines, polycarbonates, polyester-polyurethanes, polyesters, polyether-polyurethanes, polyethers, polyimides, polyketones, polyolefines, polyoxyalkylenes, polyoxyphenylenes, polysiloxanes, polysulfides, polysulfones, polythiomethylenes, polyureas, polyurethanes, polyvinyl acetals, and polyvinyl alkanoates, and natural polymers. In a preferred embodiment X is a polyether. Illustrative non-limitative examples of polyethers are: polyoxymethylene (POM), polyacetal, polyethylene oxide (PEO), polypropylene oxide (PPO), polytetrahydrofuran (PTHF). In another preferred embodiment, X is a polyethylene oxide. In another preferred embodiment, X is a polyether, A is —OH, and B is selected from —H, and (C1-C4) alkyl.

In still another preferred embodiment, X is a polyether and A and B are —OH.

In another preferred embodiment the molecule of formula (I) is one wherein X is a biradical selected from the group consisting of: (C1-C10)alkyl; (C1-C10)alkyl substituted with one or more radicals as defined above; a 2 to 10-member heteroalkyl; a 2 to 10-member heteroalkyl substituted with one or more radicals as defined above; and a homopolymer or copolymer as defined above. In another embodiment, the compound of formula (I) is one wherein X is a biradical selected from the group consisting of: (C1-C10) alkyl; a 2 to 10-member heteroalkyl; and a 2 to 10-member heteroalkyl substituted with one or more (C1-C5)alkyl radicals. In another embodiment X is a biradical selected from the group consisting of: (C1-C10)alkyl; and 2 to 10-member heteroalkyl as defined in the first aspect of the invention above. In another embodiment X is a 2 to 10-member heteroalkyl having from 2 to 10 members, being at least one of the members selected from O, S, and NH, and the remaining members are CH2 members. In another embodiment X is selected from (C1-C10)alkyl, and a 2 to 10-member heteroalkyl having from 2 to 10 members, being at least one of the members selected from O, and NH, and the remaining members are CH2 members. In another embodiment X is selected from (C1-C10)alkyl, and a 2 to 10-member heteroalkyl having from 2 to 10 members, being one or two of the members independently selected from O, and NH, and the remaining members are CH2 members. In another embodiment X is selected from (C1-C10)alkyl, and a 2 to 10 member heteroalkyl having from 2 to 10 members, being one or two of them O members and the remaining being CH2 members. In another embodiment X is selected from (C1-C10)alkyl, and a 2 to 10-member heteroalkyl having from 2 to 10 members, being one of the members NH, and the remaining being CH2 members.

In another embodiment the molecule of formula (I) is one wherein X is a biradical selected from the group consisting of: (C1-C6)alkyl; (C1-C6)alkyl substituted with one or more radicals as defined in the first aspect of the invention; a 2 to 6-member heteroalkyl; a 2 to 6-member heteroalkyl substituted with one or more radicals as defined above; and a homopolymer or copolymer as defined above. In another embodiment, the compound of formula (I) is one wherein X is a biradical selected from the group consisting of: (C1-C6)alkyl; a 2 to 6-member heteroalkyl; and a 2 to 6-member heteroalkyl substituted with one or more (C1-C5)alkyl radicals. In another embodiment X is a biradical selected from the group consisting of: (C1-C6)alkyl; and 2 to 6-member heteroalkyl as defined in the first aspect of the invention. In another embodiment X is a 2 to 6-member heteroalkyl having from 2 to 6 members, being at least one of the members selected from O, S, and NH, and the remaining members are CH2 members. In another embodiment X is selected from (C1-C6)alkyl, and a 2 to 6-member heteroalkyl having from 2 to 6 members, being at least one of the members selected from O, and NH, and the remaining members are CH2 members. In another embodiment X is selected from (C1-C6)alkyl, and a 2 to 6-member heteroalkyl having from 2 to 6 members, being one or two of the members independently selected from O, and NH, and the remaining members being CH2 members. In another embodiment X is selected from (C1-C6)alkyl, and a 2 to 6-member heteroalkyl having from 2 to 6 members, being one or two of them O member(s), and the remaining being CH2 members. In another embodiment X is selected from (C1-C6)alkyl, and a 2 to 6-member heteroalkyl having from 2 to 6 members, being one of them being a NH member, and the remaining members being CH2 members.

In another embodiment of the invention, the nanoobject comprises from 1 to 99%, from 20 to 80% or from 30 to 70% by weight of molecules of formula (I) with respect to the total weight of the nanoobject when X is a biradical selected from the group consisting of: (C1-C20)alkyl; and 2 to 20-member heteroalkyl as defined above. In another embodiment of the invention, the nanoobject comprises from 1 to 99%, from 20 to 80% or from 30 to 70% of molecules of formula (I) with respect to the total weight of the nanoobject when X is (C-1-C10)alkyl, or a 2 to 10-member heteroalkyl having from 2 to 10 members, being at least one of the members selected from O, S, and NH, and the remaining being CH2 members. In another embodiment of the invention, the nanoobject comprises from 1 to 99%, from 20 to 80% or from 30 to 70% of molecules of formula (I) with respect to the total weight of the nanoobject when X is (C1-C6)alkyl, or a 2 to 6-member heteroalkyl having from 2 to 6 members, being at least one of the members selected from O, S, and NH, and the remaining being CH2 members. In another embodiment of the invention, the nanoobject comprises from 1 to 99%, from 20 to 80% or from 30 to 70% of molecules of formula (I) with respect to the total weight of the nanoobject when X is (C1-C-10)alkyl or a 2 to 10-member heteroalkyl being at least one of the members selected from O, and NH, and the remaining being CH2 members. In another embodiment of the first aspect of the invention, the nanoobject comprises from 1 to 99%, from 20 to 80% or from 30 to 70% of molecules of formula (I) with respect to the total weight of the nanoobject when X is (C1-C6)alkyl or a 2 to 6-member heteroalkyl being at least one of the members selected from O, and NH, and the remaining being CH2 members. In another embodiment of the invention, the nanoobject comprises from 1 to 99%, from 20 to 80% or from 30 to 70% by weight of molecules of formula (I) with respect to the total weight of the nanoobject when X is selected from (C1-C10)alkyl, and a 2 to 10-member heteroalkyl having from 2 to 10 members, being one or two of the members independently selected from O, and NH, and the remaining members being CH2 members. In another embodiment of the invention, the nanoobject comprises from 1 to 99%, from 20 to 80% or from 30 to 70% by weight of molecules of formula (I) with respect to the total weight of the nanoobject when X is selected from (C1-C6)alkyl, and a 2 to 6-member heteroalkyl being one or two of the members independently selected from O, and NH, and the remaining members being CH2 members. In another embodiment of the invention, the nanoobject comprises from 1 to 99%, from 20 to 80% or from 30 to 70% by weight of molecules of formula (I) with respect to the total weight of the nanoobject when X is selected from (C1-C-10)alkyl, and a 2 to 10-member heteroalkyl having from 2 to 10 members, being one or two of them being O member(s), and the remaining being CH2 members. In another embodiment of the invention, the nanoobject comprises from 1 to 99%, from 20 to 80% or from 30 to 70% by weight of molecules of formula (I) with respect to the total weight of the nanoobject when X is selected from (C1-C6)alkyl, and a 2 to 6-member heteroalkyl having from 2 to 6 members, being one or two of them being O member(s), and the remaining being CH2 members. In another embodiment of the first aspect of the invention, the nanoobject comprises from 1 to 99%, from 20 to 80% or from 30 to 70% by weight of molecules of formula (I) with respect to the total weight of the nanoobject when X is selected from (C1-C10)alkyl, and a 2 to 10-member heteroalkyl having from 2 to 10 members, being one of them a NH member, and the remaining being CH2 members. In another embodiment of the invention, the nanoobject comprises from 1 to 99%, from 20 to 80% or from 30 to 70% by weight of molecules of formula (1) with respect to the total weight of the nanoobject when X is selected from (C1-C6)alkyl, and a 2 to 6-member heteroalkyl having from 2 to 6 members, being one of them a NH member, and the remaining being CH2 members.

In the present invention, the expression "have(has) from" has the same meaning as "comprise(s) from".

In another embodiment of the invention, the nanoobject comprises from 1 to 99%, from 15 to 99%, from 30 to 99% or from 90 to 99% by weight of molecules of formula (I) with respect to the total weight of the nanoobject, when X is a homopolymer or copolymer, as defined above. In another embodiment of the invention, the nanoobject comprises from 1 to 99%, from 15 to 99%, from 30 to 99% or from 90 to 99% by weight of molecules of formula (I) with respect to the total weight of the nanoobject, when X is a homopolymer or copolymer comprising a polyether polymeric chain. In another embodiment of the invention, the nanoobject comprises from 1 to 99%, from 15 to 99%, from 30 to 99% or from 90 to 99% by weight of molecules of formula (I) with respect to the total weight of the nanoobject when X is a homopolymer or copolymer comprising a polyethylene oxide polymeric chain.

In another embodiment of the invention, B is a radical selected from the group consisting of: H, —$NH_2$, (C1-C4)alkyl, —OH, halogen, phenyl substituted with one or more halogen radicals, benzyl substituted with one or more halogen radicals, —C(=O)$R^3$, —OC(=O)(O)$R^3$, —C(=O)($O^-$), —C(=O)(O)$R^3$, —$OR^3$, —CH($OR^3$)(OH), —C($OR^3$)(OH)($R^4$), —CH($OR^3$)($OR^4$), $NR^1R^2$, $N^+R^1R^2R^3$, —C(=$NR^1$)(H), —C(=O)($NR^1R^2$), —N(C(=O)($R^1$))(C(=O)($R^2$))($R^3$), —O(CN), —NC(=O), —$ONO_2$, —CN, —NC, —ON(=O), —$NO_2$, —NO, —$C_5H_4N$ (pyridyl), —$SR^1$, —$SSR^3$, —S(=O)($R^1$), —S(=O)(=O)($R^1$), —S(=O)(OH), —S(=O)(=O)(OH), —SCN, —NCS, —C(=S)(H), —P(=O)$(OH)_2$, —OP(=O)$(OH)_2$, —B(OH), —B($OR^1$)($OR^2$), and —B(OH)$R^1$). In another embodiment, B is a radical selected from the group consisting of: H, —$NH_2$, (C1-C4)alkyl, OH, halogen, phenyl substituted with one or more halogen radicals, —C(=O)($O^-$), —C(=O)(O)$R^3$, —$OR^3$, —$NR^1R^2$, $N^+R^1R^2R^3$, —C(=O)($NR^1R^2$), —$ONO_2$, —CN (nitrile), —NC, —$NO_2$, —NO, —$C_5H_4N$, —$SR^1$, —S(=O)(=O)($R^1$), —S(=O)(=O)(OH), —OP(=O)$(OH)_2$, —B(OH) and —B(OH)$R^1$). In still another embodiment B is H, —$NH_2$, (C1-C4)alkyl, or OH.

In another embodiment of the invention, B is a radical selected from the group consisting of: H, —OH, halogen, phenyl substituted with one or more halogen radicals, benzyl substituted with one or more halogen radicals, —C(=O)$R^3$, —OC(=O)(O)$R^3$, —C(=O)($O^-$), —C(=O)(O)$R^3$, —$OR^3$, —CH($OR^3$)(OH), —C($OR^3$)(OH)($R^4$), —CH($OR^3$)($OR^4$), $NR^1R^2$, $N^+R^1R^2R^3$, —O(=$NR^1$)(H), —C(=O)($NR^1R^2$), —N(C(=O)($R^1$))(C(=O)($R^2$))($R^3$), —O(CN), —NC(=O), —$ONO_2$, —CN, —NC, —ON(=O), —$NO_2$, —NO, —$C_5H_4N$ (pyridyl), —$SR^1$, —SSR3, —S(=O)($R^1$), —S(=O)(=O)($R^1$), —S(=O)(OH), —S(=O)(=O)(OH), —SCN, —NCS, —C(=S)(H), —P(=O)$(OH)_2$, —OP(=O)$(OH)_2$, —B(OH), —B($OR^1$)($OR^2$), and —B(OH)($R^1$). In another embodiment, B is a radical selected from the group consisting of: H, OH, halogen, phenyl substituted with one or more halogen radicals, —C(=O)(0-), —C(=O)(O)$R^3$, —$OR^3$, $NR^1R^2$, $N^+R^1R^2R^3$, —C(=O)($NR^1R^2$), —$ONO_2$, —CN (nitrile), —NC, —$NO_2$, —NO, —$C_5H_4N$, —$SR^1$, —S(=O)(=O)($R^1$), —S(=O)(=O)(OH), —OP(=O)$(OH)_2$, —B(OH) and —B($OHR^1$). In still another embodiment B is H or OH.

In one embodiment of the invention, the molecule of formula (I) is one wherein $R^1$, $R^2$, $R^3$, $R^4$, $R^5$, and $R^6$ are radicals independently selected from the group consisting of H, (C1-C10)alkyl, (C6-C-12)aryl(C1-C10)alkyl and (C6-C12)aryl. In another embodiment of the first aspect of the invention, the molecule of formula (I) is one wherein $R^1$, $R^2$, $R^3$, $R^4$, $R^5$, and $R^6$ are radicals independently selected from the group consisting of H, (C1-C3)alkyl, (C6-C12)aryl(C1-C3)alkyl and (C6-C12)aryl.

In another embodiment of the invention, the molecule of formula (I) is one where A represents —OH, and B and X are as defined in any of the above embodiments.

In another embodiment of the invention, the molecule of formula (I) is one wherein A represents —OH, B is H, OH, —$NH_2$, or (C1-C4)alkyl, and X is as defined in any of the above embodiments. In another embodiment of the invention, the molecule of formula (I) is one wherein B is —OH or H, and A and X are as defined in any of the above embodiments.

In another embodiment of the invention, the molecule of formula (I) is one wherein A represents —OH, B is —OH or H, and X is as defined in any of the above embodiments.

In another embodiment, the molecule of formula (I) is one selected from the group consisting of propylene glycol, ethylene glycol, diethylene glycol, polyethylene glycol, diethanolamine, 1,6-hexanediol, polyethyleneglycolmonomethyl ether, and 6-amino-1-hexanol.

In another embodiment, the molecule of formula (I) is one selected from the group consisting of propylene glycol, ethylene glycol, diethylene glycol, polyethylene glycol, diethanolamine, and 1,6-hexanediol.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is a biradical selected from the group consisting of: (C1-C20) alkyl; and 2 to 20-member heteroalkyl as defined above.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is selected from (C1-C10)alkyl and a 2 to 10-member heteroalkyl having from 2 to 10 members, being at least one of the members selected from O, S, and NH, and the remaining members are CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is selected from (C1-C6)alkyl and a 2 to 6-member heteroalkyl having from 2 to 6 members, being at least one of the members selected from O, S, and NH, and the remaining members are CH2 members.

In another embodiment the nanoobject comprises from 1 to 99%, from 15 to 99%, from 20 to 80% or from 30 to 70% by weight of molecules of formula (I) with respect to the total weight of the nanoobject, when: A is —OH, B is —NH2, (C C4)alkyl, —OH or H, and X is selected from (C1-C10)alkyl or a 2 to 10-member heteroalkyl having from 2 to 10 members, being at least one of the members selected from O, and NH, and the remaining members are CH2 members.

In another embodiment the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is selected from (C1-C6)alkyl or a 2 to 6-member heteroalkyl having from 2 to 6 members, being at least one of the members selected from O, and NH, and the remaining members are CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is a biradical selected from (C1-C10)alkyl, and a 2 to 10-member heteroalkyl having from 2 to 10 members, being one or two of the members independently selected from O, and NH, and the remaining members being CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, OH, or H, and X is a biradical selected from (C1-C6)alkyl, and a 2 to 6-member heteroalkyl having from 2 to 6 members, being one or two of the members independently selected from O, and NH, and the remaining members being CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, OH, H, and X is a biradical selected from (C1-C10)alkyl, and a 2 to 10-member heteroalkyl having from 2 to 10 members, being one or two of them O member(s), and the remaining members being CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is a biradical X selected from (C1-C6)alkyl, and a 2 to 6-member heteroalkyl having from 2 to 6 members, being one or two of them O member(s), and the remaining members being CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, OH, or H, and X is a biradical selected from (C1-C10)alkyl, and a 2 to 10-member heteroalkyl having from 2 to 10 members, being one of them being a NH member, and the remaining members being CH2 members.

In another embodiment of the invention, the nanoobject comprises from 1 to 99%, from 15 to 99%, from 20 to 80% or from 30 to 70% by weight of molecules of formula (I) with respect to the total weight of the nanoobject, when: A is —OH, B is —$NH_2$, (C1-C4)alkyl, —OH or H, and X is a biradical selected from (C1-C6)alkyl, and a 2 to 6-member heteroalkyl having from 2 to 6 members, being one of them being a NH member, and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical selected from the group consisting of: (C1-C20)alkyl; and 2 to 20-member heteroalkyl as defined above.

In another embodiment of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is selected from (C1-C10)alkyl and a 2 to 10-member heteroalkyl having from 2 to 10 members, being at least one of the members selected from O, S, and NH, and the remaining members are CH2 members. In another embodiment of the first aspect of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is selected from (C1-C6)alkyl and a 2 to 6-member heteroalkyl having from 2 to 6 members, being at least one of the members selected from O, S, and NH, and the remaining members are CH2 members.

In another embodiment the nanoobject comprises from 1 to 99%, from 20 to 80% or from 30 to 70% by weight of molecules of formula (I) with respect to the total weight of the nanoobject, when: A is —OH or —SH, B is —OH or H, and X is selected from (C1-C10)alkyl or a 2 to 10-member heteroalkyl having from 2 to 10 members, being at least one of the members selected from O, and NH, and the remaining members are CH2 members.

In another embodiment the nanoobject comprises from 1 to 99%, from 20 to 80% or from 30 to 70% by weight of molecules of formula (I) with respect to the total weight of the nanoobject, when: A is —OH or —SH, B is —OH or H, and X is selected from (C1-C6)alkyl or a 2 to 6-member heteroalkyl having from 2 to 6 members, being at least one of the members selected from O, and NH, and the remaining members are CH2 members.

In another embodiment of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C10)alkyl, and a 2 to 10-member heteroalkyl having from 2 to 10 members, being one or two of the members independently selected from O, and NH, and the remaining members being CH2 members.

In another embodiment of the first aspect of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C6)alkyl, and a 2 to 6-member heteroalkyl having from 2 to 6 members, being one or two of the members independently selected from O, and NH, and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical X selected from (C1-C6)alkyl, and a 2 to 10-member heteroalkyl having from 2 to 10 members, being one or two of them O member(s), and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical X selected from (C1-C6)alkyl, and a 2 to 6-member heteroalkyl having from 2 to 6 members, being one or two of them O member(s), and the remaining members being CH2 members. In another embodiment of the first aspect of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C10)alkyl, and a 2 to 10-member heteroalkyl having from 2 to 10 members, being one of them being a NH member, and the remaining members being CH2 members. In another embodiment of the first aspect of the invention, the nanoobject comprises from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C6)alkyl, and a 2 to 6-member heteroalkyl having from 2 to 6 members, being one of them being a NH member, and the remaining members being CH2 members.

In another embodiment of the invention, the nanoobject comprises from 1 to 99%, from 15 to 99%, from 30 to 99% or from 90 to 99% by weight of molecules of formula (I) with respect to the total weight of the nanoobject when: A is —OH, B is (C1-C4)alkyl, —OH or H, and X is a homopolymer or copolymer as defined above.

In another embodiment, the nanoobject comprises from 1 to 99%, from 15 to 99%, from 30 to 99% or from 90 to 99% by weight of molecules of formula (I) with respect to the total weight of the nanoobject, when: A is —OH, B is (C1-C4)alkyl, —OH or H, and X is copolymer or homopolymer comprising a polyether chain.

In another embodiment of the invention, the nanoobject comprises from 1 to 99%, from 15 to 99%, from 30 to 99% or from 90 to 99% by weight of molecules of formula (I) with respect to the total weight of the nanoobject when: A is —OH, B is (C1-C4)alkyl, —OH or H, and X is a homopolymer or copolymer comprising a polyethylene oxide chain.

In another embodiment of the invention, the nanoobject comprises from 1 to 99%, from 30 to 99% or from 90 to 99% by weight of molecules of formula (I) with respect to the total weight of the nanoobject when: A is —OH or —SH, B is —OH or H, and X is a homopolymer or copolymer as defined above.

In another embodiment, the nanoobject comprises from 1 to 99%, from 30 to 99% or from 90 to 99% by weight of molecules of formula (I) with respect to the total weight of the nanoobject, when: A is —OH or —SH, B is —OH or H, and X is copolymer or homopolymer comprising a polyether chain.

In another embodiment of the invention, the nanoobject comprises from 1 to 99%, from 30 to 99% or from 90 to 99% by weight of molecules of formula (I) with respect to the total weight of the nanoobject when: A is —OH or —SH, B is —OH or H, and X is a homopolymer or copolymer comprising a polyethylene oxide chain.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is a biradical selected from the group consisting of: (C1-C20)alkyl; and 2 to 20-member heteroalkyl as defined above.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is selected from (C1-C10)alkyl and a 2 to 10-member heteroalkyl having from 2 to 10 members, being at least one of the members selected from O, S, and NH, and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is selected from (C1-C6)alkyl and a 2 to 6-member heteroalkyl having from 2 to 6 members, being at least one of the members selected from O, S, and NH, and the remaining members being CH2 members.

In another embodiment the nanoobject comprises from 1 to 99%, from 20 to 80% or from 30 to 70% by weight of molecules of formula (I) with respect to the total weight of the nanoobject, when: A is —OH, B is —OH or H, and X is selected from (C1-C10)alkyl or a 2 to 10-member heteroalkyl having from 2 to 10 members, being at least one of the members selected from O, and NH, and the remaining members are CH2 members.

In another embodiment the nanoobject comprises from 1 to 99%, from 20 to 80% or from 30 to 70% by weight of molecules of formula (I) with respect to the total weight of the nanoobject, when: A is —OH, B is —OH or H, and X is selected from (C1-C6)alkyl or a 2 to 6-member heteroalkyl having from 2 to 6 members, being at least one of the members selected from O, and NH, and the remaining members are CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is a biradical selected from (C1-C10)alkyl, and a 2 to 10-member heteroalkyl having from 2 to 10 members, being one or two of the members independently selected from O, and NH, and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is a biradical selected from (C1-C6)alkyl, and a 2 to 6-member heteroalkyl having from 2 to 6 members, being one or two of the members independently selected from O, and NH, and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is a biradical selected from (C1-C10)alkyl, and a 2 to 10-member heteroalkyl having from 2 to 10 members, being one or two of them O member(s), and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H, and X is a biradical selected from (C1-C6)alkyl, and a 2 to 6-member heteroalkyl having from 2 to 6 members, being one or two of them O member(s), and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H; and X is a biradical selected from (C1-C10)alkyl, and a 2 to 10-member heteroalkyl having from 2 to 10 members, being one of them a NH member, and the remaining members being CH2 members.

In another embodiment of the invention, the nanoobject comprises from 1 to 99%, from 20 to 80% or from 30 to 70% by weight of molecules of formula (I) with respect to the total weight of the nanoobject, when: A is —OH, B is —OH or H; and X is a biradical selected from (C1-C6)alkyl, and a 2 to 6-member heteroalkyl having from 2 to 6 members, being one of them a NH member, and the remaining members being CH2 members.

In another embodiment of the invention, the nanoobject comprises from 1 to 99%, from 30 to 99% or from 90 to 99% by weight of molecules of formula (I) with respect to the total weight of the nanoobject when: A is —OH, B is —OH or H, and X is a homopolymer or copolymer as defined above. In another embodiment, the nanoobject comprises from 1 to 99%, from 30 to 99% or from 90 to 99% by weight of molecules of formula (I) with respect to the total weight of the nanoobject, when: A is —OH, B is —OH or H, and X is copolymer or homopolymer comprising a polyether chain.

In another embodiment of the invention, the nanoobject comprises from 1 to 99%, from 30 to 99% or from 90 to 99% by weight of molecules of formula (I) with respect to the total weight of the nanoobject when: A is —OH, B is —OH or H, and X is a homopolymer or copolymer comprising a polyethylene oxide chain.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4)alkyl, $NH_2$, —OH or H, and X is a biradical selected from the group consisting of: (C1-C20)alkyl; and 2 to 20-member heteroalkyl as defined above.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H; and X is selected from (C1-C10)alkyl and a 2 to 10-member heteroalkyl having from 2 to 10 members, being at least one of the members selected from O, S, and NH, and the remaining members are CH2 members.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H; and X is selected from (C1-C6)alkyl and a 2 to 6-member heteroalkyl having from 2 to 6 members, being at least one of the members selected from O, S, and NH, and the remaining members are CH2 members.

In another embodiment the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H, and X is selected from (C1-C10)alkyl or a 2 to 10-member heteroalkyl having from 2 to 10 members, being at least one of the members selected from O, and NH, and the remaining members being CH2 members.

In another embodiment the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H; and X is selected from (C1-C6)alkyl or a 2 to 6-member heteroalkyl having from 2 to 6 members, being at least one of the members selected from O, and NH, and the remaining members being CH2 members. In another embodiment of the first aspect of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H, and X is a biradical selected from (C1-C10)alkyl, and a 2 to 10-member heteroalkyl having from 2 to 10 members, being one or two of the members independently selected from O, and NH, and the remaining members being CH2 members.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H, and X is a biradical selected from (C1-C6)alkyl, and a 2 to 6-member heteroalkyl having from 2 to 6 members, being one or two of the members independently selected from O, and NH, and the remaining members being CH2 members.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H, and X is a biradical X selected from (C1-C10)alkyl, and a 2 to 10-member heteroalkyl having from 2 to 10 members, being one or two of them O member(s), and the remaining members being CH2 members.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H, and X is a biradical X selected from (C1-C6)alkyl, and a 2 to 6-member heteroalkyl having from 2 to 6 members, being one or two of them a O member, and the remaining members being CH2 members.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4), $NH_2$, —OH or H, and X is a biradical selected from (C1-C10)alkyl, and a 2 to 10-member heteroalkyl having from 2 to 10 members, being one of them a NH member, and the remaining members being CH2 members.

In another embodiment of the invention, the nanoobject is a $MoS_2$ nanoobject comprising from 1 to 99%, from 15 to 99%, from 20 to 80% or from 30 to 70% by weight of molecules of formula (I) with respect to the total weight of the nanoobject, when: A is —OH, B is (C1-C4)alkyl, $NH_2$, —OH or H; and X is a biradical selected from (C1-C6)alkyl, and a 2 to 6-member heteroalkyl having from 2 to 6 members, being one of them a NH member, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is a biradical selected from the group consisting of: (C1-C20)alkyl; and 2 to 20-member heteroalkyl as defined above.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H; and X is selected from (C1-C10)alkyl and a 2 to 10-member heteroalkyl having from 2 to 10 members, being at least one of the members selected from O, S, and NH, and the remaining members are CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H; and X is selected from (C1-C6)alkyl and a 2 to 6-member heteroalkyl having from 2 to 6 members, being at least one of the members selected from O, S, and NH, and the remaining members are CH2 members.

In another embodiment the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is selected from (C1-C10) alkyl or a 2 to 10-member heteroalkyl having from 2 to 10 members, being at least one of the members selected from O, and NH, and the remaining members being CH2 members.

In another embodiment the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H; and X is selected from (C1-C6)alkyl or a 2 to 6-member heteroalkyl having from 2 to 6 members, being at least one of the members selected from O, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C10)alkyl, and a 2 to 10-member heteroalkyl having from 2 to 10 members, being one or two of the members independently selected from O, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C6)alkyl, and a 2 to 6-member heteroalkyl having from 2 to 6 members, being one or two of the members independently selected from O, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is a biradical X selected from (C1-C10)alkyl, and a 2 to 10-member heteroalkyl having from 2 to 10 members, being one or two of them O member(s), and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is a biradical X selected from (C1-C6)alkyl, and a 2 to 6-member heteroalkyl having from 2 to 6 members, being one or two of them a O member, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H, and X is a biradical selected from (C1-C10)alkyl, and a 2 to 10-member heteroalkyl having from 2 to 10 members, being one of them a NH member, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH or —SH, B is —OH or H; and X is a biradical selected from (C1-C6)alkyl, and a 2 to 6-member heteroalkyl having from 2 to 6 members, being one of them a NH member, and the remaining members being CH2 members.

In another embodiment of the invention, the nanoobject is a $MoS_2$ nanoobject comprising from 1 to 99%, from 30 to 99% or from 90 to 99% by weight of molecules of formula (I) with respect to the total weight of the nanoobject when: A is —OH or —SH, B is —OH or H, and X is a homopolymer or copolymer as defined above.

In another embodiment, the nanoobject is a $MoS_2$ nanoobject comprising from 1 to 99%, from 30 to 99% or from 90 to 99% by weight of molecules of formula (I) with respect to the total weight of the nanoobject, when: A is —OH or —SH, B is —OH or H, and X is copolymer or homopolymer comprising a polyether chain.

In another embodiment of the first aspect of the invention, the nanoobject is a $MoS_2$ nanoobject comprising from 1 to 99%, from 30 to 99% or from 90 to 99% by weight of molecules of formula (I) with respect to the total weight of the nanoobject when: A is —OH or —SH, B is —OH or H, and X is a homopolymer or copolymer comprising a polyethylene oxide chain.

In another embodiment of the first aspect of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is a biradical selected from the group consisting of: (C1-C20)alkyl; and 2 to 20-member heteroalkyl as defined above.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is selected from (C1-C10)alkyl and a 2 to 10-member heteroalkyl having from 2 to 10 members, being at least one of the members selected from O, S, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is selected from (C1-C6)alkyl and a 2 to 6-member heteroalkyl having from 2 to 6 members, being at least one of the members selected from O, S, and NH, and the remaining members being CH2 members.

In another embodiment the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is selected from (C1-C10)alkyl or a 2 to 10-member heteroalkyl having from 2 to 10 members, being at least one of the members selected from O, and NH, and the remaining members being CH2 members.

In another embodiment the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H; and X is selected from (C1-C6)alkyl or a 2 to 6-member heteroalkyl having from 2 to 6 members, being at least one of the members selected from O, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is a biradical selected from (C1-C6)alkyl, and a 2 to 10-member heteroalkyl having from 2 to 10 members, being one or two of the members independently selected from O, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is a biradical selected from (C1-C6)alkyl, and a 2 to 6-member heteroalkyl having from 2 to 6 members, being one or two of the members independently selected from O, and NH, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H and X is a biradical selected from (C1-C10)alkyl, and a 2 to 10-member heteroalkyl having from 2 to 10 members, being one or two of them O member(s), and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is a biradical selected from (C1-C6)alkyl, and a 2 to 6-member heteroalkyl having from 2 to 6 members, being one or two of them O member(s), and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H, and X is a biradical selected from (C1-C10)alkyl, and a 2 to 10-member heteroalkyl having from 2 to 10 members, being one of them a NH member, and the remaining members being CH2 members.

In another embodiment of the invention, the nanoobject is a $MoS_2$ nanoobject comprising from 1 to 99%, from 20 to 80% or from 30 to 70% by weight of molecules of formula (I) with respect to the total weight of the nanoobject, when: A is —OH, B is —OH or H; and X is a biradical selected from (C1-C6)alkyl, and a 2 to 6-member heteroalkyl having from 2 to 6 members, being one of them a NH member, and the remaining members being CH2 members.

In another embodiment of the invention, the nanoobject is a $MoS_2$ nanoobject comprising from 1 to 99%, from 30 to 99% or from 90 to 99% by weight of molecules of formula (I) with respect to the total weight of the nanoobject when: A is —OH, B is —OH or H, and X is a homopolymer or copolymer as defined above.

In another embodiment, the nanoobject is a $MoS_2$ nanoobject comprising from 1 to 99%, from 30 to 99% or from 90 to 99% by weight of molecules of formula (I) with respect to the total weight of the nanoobject, when: A is —OH, B is —OH or H, and X is copolymer or homopolymer comprising a polyether chain.

In another embodiment of the invention, the nanoobject is a $MoS_2$ nanoobject comprising from 1 to 99%, from 30 to 99% or from 90 to 99% by weight of molecules of formula (I) with respect to the total weight of the nanoobject when: A is —OH, B is —OH or H, and X is a homopolymer or copolymer comprising a polyethylene oxide chain.

In another embodiment of the invention the object size is comprised from 0.1 to 500 nm.

In another embodiment, when the nanoobject is spherical, the object size is comprised from 10 to 500 nm, from 20 to 250 nm or from 30 to 100 nm. In another embodiment, when the nanoobject has box-shape, the object size is comprised from 0.1 to 50 nm, from 0.2 to 30 nm or from 0.3 to 15 nm. In another embodiment, when the nanoobject has rod-shape, the object size is comprised from 1 to 100 nm, from 5 to 50 nm or from 10 to 30 nm.

In another embodiment of the invention, the nanoobject comprises a single type of molecule of formula (I). This means, for instance, that the surface of the nanoobject is functionalized with uniquely propylene glycol molecules, or alternatively by ethylene glycol molecules, or alternatively by diethylene glycol molecules, or alternatively by polyethylene glycol molecules, or alternatively by polyethylene glycol monomethyl ether, or alternatively by diethanolamine molecules, or alternatively by 1,6-hexanediol molecules, or alternatively by 6-amino-1-hexanol molecules.

In another embodiment of the invention, the surface the nanoobject comprises different molecules of formula (I). This means that the surface of the nanoobject can be functionalized with a mixture of two or more different molecules of formula (I), such as propylene glycol molecules plus diethylene glycol molecules, or polyethylene glycol molecules plus 1,6-hexanediol molecules.

Preferably, the nanoobject of the invention is $MoS_2$ functionalized with polyalkylene glycol, preferably polyethylene glycol (PEG), particularly polyethylene glycol of molecular weight 10000) (PEG10000).

In a specific embodiment, the polyethylene glycol represents between 60 and 99% of the total weight content of the nanoobject. Preferably, the polyethylene glycol represents 94% of the total weight content of the nanoobject.

Eventually, in an alternative embodiment, the lubricant composition according to the invention may comprise two kinds of nanoobjects as defined above.

The base oils used in the lubricant compositions according to the invention may be oils of mineral or synthetic origins belonging to the groups I to V according to the classes defined by the API classification (or their equivalents according to the ATIEL classification) (table A) or mixtures thereof.

TABLE A

| | Contents of saturated substances | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Polyalphaolefins (PAO) | | |
| Group V | Esters and other bases not included in the groups I to IV | | |

The mineral base oils according to the invention include all types of bases obtained by atmospheric and in vacuo distillation of crude oil, followed by refining operations such as extraction with a solvent, de-asphalting, de-waxing with a solvent, hydro-treatment, hydrocracking, hydroisomerization and hydrofinishing.

Mixtures of synthetic and mineral oils may also be used.

The base oils of the lubricant compositions according to the invention may also be selected from among synthetic oils, such as certain esters of carboxylic acids and of alcohols, and from among polyalphaolefins. The polyalphaolefins used as base oils are for example obtained from monomers comprising from 4 to 32 carbon atoms, for example from octene or decene, and for which the viscosity at 100° C. is comprised between 1.5 and 15 $mm^2 \cdot s^{-1}$ according to the ASTM D445 standard. Their average molecular mass is generally comprised between 250 and 3,000 according to the ASTM D5296 standard.

The lubricating composition according to the invention may comprise at least 50% by volume of base oils based on the total mass of the composition. More advantageously, the lubricant composition according to the invention comprises at least 60% by volume, or even at least 70% by volume, of base oils based on the total volume of the composition. In a more particularly advantageous way, the lubricant composition according to the invention comprises from 75 to 97% by volume of base oils based on the total mass of the composition.

The composition of the invention can also comprise at least one additive.

Many additives may be used for this lubricant composition according to the invention.

The preferred additives for the lubricant composition according to the invention are selected from among detergent additives, anti-wear additives, friction modifier additives different from nanoobject described above, extreme pressure additives, dispersants, enhancers of the pour point, anti-foam agents, thickeners and mixtures thereof.

Preferably, the lubricant composition according to the invention comprises at least one anti-wear additive, at least one extreme pressure additive or mixtures thereof.

The anti-wear additives and the extreme pressure additives protect the friction surfaces by forming a protective film adsorbed on these surfaces.

There exist a large variety of anti-wear additives. Preferably for the lubricant composition according to the invention, the anti-wear additives are selected from among phosphorus-sulfur-containing additives like metal alkylthiophosphates, in particular zinc alkylthiophosphates, and more specifically zinc dialkyldithiophosphates or ZnDTP. The preferred compounds are of formula $Zn((SP(S)(OR)(OR'))_2$, wherein R and R', either identical or different, represent independently an alkyl group, preferentially an alkyl group including from 1 to 18 carbon atoms.

The amine phosphates are also anti-wear additives which may be used in the lubricant composition according to the invention. However, the phosphorus brought by these additives may act as a poison of catalytic systems of automobiles since these additives are ash generators. It is possible to minimize these effects by partly substituting the amine phosphates with additives not providing any phosphorus, such as for example, polysulfides, notably sulfur-containing olefins.

Advantageously, the lubricant composition according to the invention may comprise from 0.01 to 6% by mass, preferentially from 0.05 to 4% by mass, more preferentially from 0.1 to 2% by mass based on the total mass of lubricant composition, of anti-wear additives and extreme pressure additives.

Advantageously, the lubricant composition according to the invention may comprise at least one friction modifier additive different from the nanoobject of the invention. The friction modifier additive may be selected from among a compound providing metal elements and a compound free of ashes. Among the compounds providing metal elements, mention may be made of complexes of transition metals such as Mo, Sb, Sn, Fe, Cu, Zn for which the ligands may be hydrocarbon compounds comprising oxygen, nitrogen, sulfur or phosphorus atoms. The friction modifier additives free of ashes are generally of organic origin and may be selected from among fatty acid monoesters and from polyols, alkoxylated amines, alkoxylated fatty amines, fatty epoxides, borate fatty epoxides; fatty amines or esters of fatty acid glycerol. According to the invention, the fatty compounds comprise at least one hydrocarbon group comprising from 10 to 24 carbon atoms.

Advantageously, the lubricant composition according to the invention may comprise from 0.01 to 2% by mass or from 0.01 to 5% by mass, preferentially from 0.1 to 1.5% by mass or from 0.1 to 2% by mass based on the total mass of the lubricant composition, of a friction modifier additive different from the nanoobject of the invention.

Advantageously, the lubricating composition (or lubricant composition) according to the invention may comprise at least one antioxidant additive.

The antioxidant additive may generally delay the degradation of the lubricant composition being used. This degradation may notably be expressed by the formation of deposits, by the presence of sludges or by an increase in the viscosity of the lubricant composition.

The antioxidant additives notably act as radical inhibitors or hydroperoxide destructive inhibitors. From among the currently used antioxidant additives, mention may be made of the antioxidant additives of the phenolic type, of the antioxidant additives of the aminated type, of the phosphorus-sulfur-containing antioxidant additives. Certain of these antioxidant additives, for example the phosphorus-sulfur-containing antioxidant additives may be generators of ashes. The antioxidant phenolic additives may be free of ashes or else be in the form of metal salts either neutral or basic. The antioxidant additives may notably be selected from among sterically hindered phenols, sterically hindered phenol esters and sterically hindered phenols comprising a thioether bridge, diphenylamines, diphenylamines substituted with at least one $C_1$-$C_{12}$ alkyl group, N,N'-dialkyl-aryl-diamines and mixtures thereof.

Preferably according to the invention, the sterically hindered phenols are selected from among the compounds comprising a phenol group for which at least one carbon in the neighborhood of the carbon bearing the alcohol function is substituted with at least one $C_1$-$C_{10}$ alkyl group, preferably a $C_1$-$C_6$ alkyl group, preferably a $C_4$alkyl group, preferably by the ter-butyl group.

The aminated compounds are another class of antioxidant additives which may be used, optionally in combination with phenolic antioxidant additives. Examples of aminated compounds are aromatic amines, for example aromatic amines of formula $NR^aR^bR^c$ wherein Ra represents an aliphatic group or an aromatic group, optionally substituted, $R^b$ represents an aromatic group, optionally substituted, $R^c$ represents a hydrogen atom, an alkyl group, an aryl group or a group of formula $R^dS(O)_zR^e$ wherein $R^d$ represents an alkylene group or an alkenylene group, $R^e$ represents an alkyl group, an alkenyl group or an aryl group and z represents 0, 1 or 2.

Sulfur-containing phenol alkyls or their alkaline metal and earth-alkaline metal salts may also be used as antioxidant additives.

Another class of antioxidant additives is that of copper-containing compounds, for examples copper thio- or dithiophosphates, copper salts and of carboxylic acids, dithiocarbamates, sulphonates, phenates, copper acetylacetonates. The copper salts I and II, salts of succinic acid or anhydride may also be used.

The lubricant composition according to the invention may contain any types of antioxidant additives known to one skilled in the art.

Advantageously, the lubricant composition comprises at least one antioxidant additive free of ashes.

Also advantageously, the lubricant composition according to the invention comprises from 0.1 to 2% by weight based on the total mass of the composition, of at least one antioxidant additive.

The lubricant composition according to the invention may also comprise at least one detergent additive.

Detergent additives generally give the possibility of reducing the formation of deposits at the surface of metal parts by dissolving secondary oxidation and combustion products.

The detergent additives which may be used in the lubricant composition according to the invention are generally known to one skilled in the art. The detergent additives may be anionic compounds comprising a long lipophilic hydrocarbon chain and a hydrophilic head. The associated cation may be a metal cation of an alkaline or earth-alkaline metal.

The detergent additives are preferentially selected from among salts of alkaline metals or of earth-alkaline metals of carboxylic acids, sulfonates, salicylates, naphthenates, as well as salts of phenates. The alkaline and earth-alkaline metals are preferentially calcium, magnesium, sodium or barium.

These metal salts generally comprise the metal in a stoichiometric amount or else in an excess amount, therefore in an amount greater than the stoichiometric amount. These are then overbased detergent additives; the excess metal providing the overbased nature to the detergent additive is then generally in the form of a metal salt insoluble in oil, for example a carbonate, a hydroxide, an oxalate, an acetate, a glutamate, preferentially a carbonate.

Advantageously, the lubricant composition according to the invention may comprise from 0.5 to 8% or from 2 to 4% by weight of a detergent additive based on the total mass of the lubricant composition.

Also advantageously, the lubricant composition according to the invention may also comprise at least one pour point lowering additive.

By slowing down the formation of paraffin crystals, the pour point lowering additives generally improve the cold behavior of the lubricant composition according to the invention.

As an example of pour point lowering additives, mention may be made of alkyl polymethacrylates, polyacrylates, polyarylamides, polyalkylphenols, polyalkylnaphthalenes, alkyl polystyrenes.

Advantageously, the lubricant composition according to the invention may also comprise a dispersant agent.

The dispersant agent may be selected from among Mannich bases, succinimides and derivatives thereof.

Also advantageously, the lubricant composition according to the invention may comprise from 0.2 to 10% by mass of a dispersant agent based on the total mass of the lubricant composition.

Advantageously, the lubricant composition may also comprise at least one additional polymer improving the viscosity index. As examples of an additional polymer improving the viscosity index, mention may be made of polymeric esters, homopolymers or copolymers, either hydrogenated or not, hydrogenated, of styrene, of butadiene and of isoprene, polymethacrylates (PMA). Also advantageously, the lubricant composition according to the invention may comprise from 1 to 15% by mass based on the total mass of the lubricant polymeric composition improving the viscosity index.

The lubricant composition according to the invention may also comprise at least one thickener agent.

The lubricant composition according to the invention may also comprise antifoam agent and demulsifying agent.

According to an embodiment, the kinematic viscosity at 100° C. of the lubricant composition according to the invention is less than 9.9 $mm^2/s$ and/or the mid-point of the kinematic viscosity at 40° C. of lubricant composition is less than 1650 $mm^2/s$.

The kinematic viscosity can be measured according to ASTM D445 standard.

The mid-point corresponds to the mean of the cinematic viscosity measured for the composition at 40° C.

Preferably, the lubricant composition according to the invention comprises:

At least a base oil;

0.01 to 15%, preferably from 0.1 to 5%, by weight, based on the total weight of the lubricant composition, of active ingredient of nanoobject according to the invention;

Preferably, the lubricant composition according to the invention comprises:

At least a base oil;

0.01 to 15%, preferably from 0.1 to 5%, by weight, based on the total weight of the lubricant composition, of active ingredient of nanoobject according to the invention;

At least a dispersant.

According to an embodiment, the lubricant composition of the invention comprises, based on the total weight of the lubricant composition:

At least 50% by weight, preferably from 60 to 98% by weight, more preferably from 70 to 95% by weight, of base oil(s);

from 0.1 to 5% by weight, preferably from 1 to 3% by weight, of active ingredient of nanoobject according to the invention, from 0.01 to 5% by weight of dispersant(s), preferably from 0.1 to 3% by weight, of dispersant(s), Optionally from 0.01 to 30% by weight, preferably from 0.1 to 20% by weight of additive(s) other than the nanoobjects of the invention and other than dispersants.

The inventors have surprisingly found that the use of the composition according to the invention for lubricating gear provides scaling resistant properties, preferentially compared to the same composition without nanoparticles, and enables an increase of the yield of the gear, preferentially compared to the same composition without nanoparticles.

The inventors have also surprisingly found that the use of the nanoobject according to the invention enables the formation of robust inorganic tribofilm even with fluid grade oil while providing scaling resistant.

The present invention also relates to the use of nanoobject according to the invention for lubricating gear.

The present invention also relates to the use of the nanoobjects according to the invention to improve the tribochemistry of lubricating composition for lubricating gear, even in formulated lubricating composition even in fluid grade oil.

In the present invention, formulated lubricating composition refers to lubricating composition comprising base oil and at least one additive of the type mentioned above (dispersant, etc.).

The present invention also relates to a process for lubricating gearing, for example vehicle gearing or industrial gearing, comprising at least one step of bringing the gearing into contact with the lubricant composition according to the invention.

The present invention also relates to a process for providing scaling resistant properties to a lubricating composition comprising the addition to the lubricating composition of nanoobject according to the invention.

The invention also relates to a process for increasing the yield of a gearing comprising at least one step of bringing gear into contact with the lubricant composition according to the invention.

In the present invention, gearing comprises any gear that can be found in a vehicle, in marine or in an industrial machine. For examples gears are chosen among: gearbox (manual or automatic), industrial gear, drive elements, bearings, universal joints, the pistons/rings/liners system, camshafts, clutch, axles, rocker arms, housings etc. . . . .

The invention will now be described with the following non-limiting examples.

Example 1: Nanoobject of the Invention

Synthesis of MoS20D nanoobjects functionalized with DEG.

A total amount of 0.05 mmol of sodium molybdate and 0.28 mmol of thiourea were stirred in 7.68 ml of diethylene glycol (DEG) under air atmosphere at 220° C. for 180 min.

After that, the reactor was quenched to room temperature and nanoobjects were isolated and purified. To remove the excess of reactants, solvent and co-products, the samples were washed by centrifugation: two times with ethanol, another two times with pure water and finally were washed one time with ethanol. Finally, the nanoobjects were dried at room temperature.

This synthesis corresponds to example 1 of WO2016156543.

The organic content of the 0D nanoobjects was about 46% (weight).

Example 2: Lubricating Composition

The following compositions (composition according to the invention (LC1) and comparative composition (CC1)) were prepared by mixing the different constituents:

| | LC1 | CC1 |
|---|---|---|
| Gearbox oil KV100 6.5 (wt %) | 98.8 | 100 |
| Nanoobject of example 1 (wt % active ingredient) | 1.2 | / |

Example 3: Performance Tests (Efficiency)

These tests have been performed on the basis of standard FVA 345.

$X_{L0}$, $X_{LL}$ and $X_{LG}$ indicate the relative losses of CC1 and LC1 compositions compared to the reference oil FVA3A. The measured have been made at 40 and 120° C.

The no load loss coefficient $X_{L0}$ indicates the relative no-load losses compared to FVA3A. For lubricants with a higher viscosity than FVA3A the no-load loss coefficient usually shows values $X_{L0}>1$, for lubricants with lower viscosity values $X_{L0}<1$ are derived. This factor reflects the lubricant viscosity in relation to the viscosity of the reference oil as the main influence. The no load loss coefficient should differ by at least A $X_{L0}=0.15$ to discriminate two oils on a 95% probability level.

The load coefficient $X_{LL}$ describes the frictional behaviour at predominantly EHD-lubrication conditions and is calculated from the load dependent losses at operating conditions in the mixed lubrication and EHD-regime compared to the comparable operating conditions with the reference oil FVA3A. $X_{LL}$ expresses mainly the influence of the base oil on the frictional behaviour of the lubricant. The load dependent loss coefficient should differ by $\Delta X_{LL}=0.07$ to discriminate two oils on a 95% probability level.

The loss coefficient $X_{LG}$ describes the relative load dependent losses compared with the reference data of FVA3A at operating conditions where usually boundary lubrication occurs. The boundary loss coefficient $X_{LG}$ expresses mainly the influence of the additive system on the frictional behaviour of the lubricant. The boundary lubrication loss coefficient $X_{LG}$ should differ by $\Delta X_{LG}=0.05$ to discriminate two oils on a 95% probability level.

The results are given in the below table.

| | $X_{L0}$ significate difference 0.15 | | $X_{LL}$ significate difference 0.07 | | $X_{LG}$ significate difference 0.05 | |
|---|---|---|---|---|---|---|
| Composition | 40° C. | 120° C. | 40° C. | 120° C. | 40° C. | 120° C. |
| CC1 | 0.7 | 0.95 | 0.84 | 0.87 | 1.04 | 1.5 |
| LC1 | 0.76 | 1.00 | 0.86 | 0.80 | 0.95 | 1.22 |

The results show that the composition according to the invention enables to reduce the $X_{LL}$ and $X_{LG}$ especially at high temperature. Thus the composition of the invention enables to improve the yield of the gear.

Example 4: Performance Tests (Anti-Pitting)

The objective of the test is to evaluate the aptitude of a composition to protect gears against degradation by pitting. The test corresponds to an accelerated pitting wherein the gear are first loaded with 135 mN for two hours at 2900 rpm then 20 hours and then the charge is gradually uploaded. The tests I finished when the failure criterion is achieved.

The conditions of the test are the following:

Running-in: 2900 rpm (+/−3%)—level 5 (135 mN)—room temperature—2 hours

Tests:

2900 rpm+/−3%

110° C.+/−3° C. regulated oil temperature level 6 (135 Nm on gearwheel) 20 h level 7 (183 Nm on gearwheel) 2*10 h level 8 (239 Nm on gearwheel) 4*5 h level 9 (302 Nm on gearwheel) 4*5 h level 10 (373 Nm on gearwheel) 4*5 h Failure criterion 4% scaling only on one tooth (i.e. 5 $mm^2$)

or 1% scaling for all teeth (i.e. 18 $mm^2$)

The results are given in the following table:

| | Tests duration without achieving of the failure criterion | Tests duration at the first observation of the failure criterion | last level reached |
|---|---|---|---|
| CC1 | 60 | 65 | 8 |
| LC1 | 80 | 85 | 9 |

The results show that the composition according to the invention enables an improvement of anti-pitting. The composition according to the invention enables to avoid or delay the scaling phenomenon.

The invention claimed is:

1. A method for lubricating gearing comprising at least one step of bringing the gearing into contact with a lubricating composition comprising:

a base oil; and a Molybdenum or Tungsten chalcogenide nanoobject having an object size comprised from 0.1 to 500 nm and from 1 to 99% by weight of molecules of formula (I) with respect to the total weight of the nanoobject, wherein the surface of the nanoobject is functionalized with the molecules of formula (I),

A-X-B (I)

wherein the molecule of formula (I) is selected from the group consisting of: propylene glycol, ethylene glycol, diethylene glycol, polyethylene glycol, diethanolamine, 1,6-hexanediol, polyethyleneglycolmonomethyl ether, 6-amino-1-hexanol, and polyalkylene glycol.

2. The method according to claim 1, wherein the Molybdenum or Tungsten chalcogenide nanoobject is a Molybdenum chalcogenide of sulfide, selenide or telleride.

3. The method according to claim 1, wherein the Molybdenum or Tungsten chalcogenide nanoobject is $MoS_2$.

4. The method according to claim 1, wherein the Molybdenum or Tungsten chalcogenide nanoobject is $MoS_2$ functionalized with polyalkylene glycol.

5. The method according to claim 1, wherein a kinematic viscosity at 100° C. of the lubricant composition is less than 9.3 $mm^2/s$ and/or a mid-point of kinematic viscosity at 40° C. of the lubricant composition is less than 68 $mm^2/s$.

6. A method for lubricating gearing comprising at least one step of bringing the gearing into contact with a lubricating composition comprising a Molybdenum or Tungsten chalcogenide nanoobject having an object size comprised from 0.1 to 500 nm and from 1 to 99% by weight of molecules of formula (I) with respect to the total weight of the nanoobject, wherein the surface of the nanoobject is functionalized with the molecules of formula (I),

A-X-B (I)

wherein the molecule of formula (I) is selected from the group consisting of: propylene glycol, ethylene glycol, diethylene glycol, polyethylene glycol, diethanolamine, 1,6-hexanediol, polyethyleneglycolmonomethyl ether, and 6-amino-1-hexanol.

7. A method for improving tribochemistry of a lubricating composition for lubricating gear comprising adding to said lubricating composition nanoobjects as defined in claim 1.

8. A method for providing scaling resistant properties to a lubricating composition comprising the addition to the lubricating composition of nanoobject as defined in claim 1.

9. A method for increasing the yield of a gear comprising at least one step of bringing gear into contact with the lubricant composition as defined in claim 1.

10. The method of claim 1, wherein the molecule of formula (I) is selected from the group consisting of: propylene glycol, ethylene glycol, diethylene glycol, polyethylene glycol, diethanolamine, and 1,6-hexanediol.

11. The method of claim 1, wherein the lubricant composition comprises at least one base oil and from 0.1 to 5% by weight of active ingredient of the Molybdenum or Tungsten chalcogenide nanoobject based on the total weight of the lubricant composition.

12. A method for protecting gears against degradation by pitting comprising at least one step of bringing the gears into contact with the lubricant composition as defined in claim 1.

* * * * *